US005505064A

United States Patent [19]

Wang

[11] Patent Number: 5,505,064

[45] Date of Patent: Apr. 9, 1996

[54] SHACKLE LOCK

[76] Inventor: Lo-Pin Wang, 5F, No. 1, Lane 85 Kwang Fu North Rd., Taipei City, Taiwan

[21] Appl. No.: 377,810

[22] Filed: Jan. 25, 1995

[51] Int. Cl.[6] ..... E05B 67/06

[52] U.S. Cl. ..... 70/53; 70/39; 70/51

[58] Field of Search ..... 76/53, 18–19, 76/36–37, 38 R, 38 A, 39, 233; 70/51, 58, 54–56

[56] References Cited

U.S. PATENT DOCUMENTS

| | | | |
|---|---|---|---|
| 1,477,777 | 12/1923 | Shek | 70/53 |
| 3,678,717 | 7/1972 | Eaton | 70/51 |
| 3,766,757 | 10/1973 | Storey | 70/18 |
| 4,070,879 | 1/1978 | Thompson | 70/39 |
| 4,256,322 | 3/1981 | Otsuka | 70/233 |
| 4,676,080 | 6/1987 | Schwarz | 70/58 |
| 5,291,765 | 3/1994 | Hoisington | 70/18 |
| 5,333,476 | 8/1994 | Byrd | 70/38 A |
| 5,398,529 | 3/1995 | Goldman | 70/38 A |
| 5,440,904 | 8/1995 | Su | 70/18 |

*Primary Examiner*—Steven N. Meyers
*Assistant Examiner*—Gary Estremsky
*Attorney, Agent, or Firm*—Browdy and Neimark

[57] ABSTRACT

A shackle lock comprises a body, a first shackle, a second shackle, and two holding bodies. The first shackle is engageable at both ends thereof with two insertion holes of the body while the second shackle is engageable at both ends thereof with the two holding bodies, which are provided respectively with an axial hole in which the body is held. The two holding bodies are further provided with two oblong through holes corresponding in location to the insertion hole of the body. The two oblong through holes of the holding body are opposite in location to each other. One of the two oblong through holes of each of the two holding bodies is engageable with the first shackle.

7 Claims, 4 Drawing Sheets

SHACKLE LOCK

FIELD OF THE INVENTION

The present invention relates generally to a shackle lock, and more particularly to a shackle lock having two shackles.

BACKGROUND OF THE INVENTION

The prior art shackle lock is generally composed of a body and a shackle of a U-shaped construction. The shackle is engaged at both ends thereof with two insertion holes of the body. Located at one end or the center of the body is a lock core engageable with a key. A shackle lock of a large size is capable of locking two bicycles together or of fastening a bicycle to a tree trunk or a telephone pole. The length of the shackle of such a large shackle lock as described above may be as long as 310 millimeters. It is therefore conceivable that the large shackle lock as such should take up too much of a space in the bicycle rack, and that the shackle and the body can be separated forcibly by means of a jack.

SUMMARY OF THE INVENTION

It is therefore the primary objective of the present invention to provide a burglarproof shackle lock, which comprises two shackles.

It is another objective of the present invention to provide a shackle lock, which is composed of two shackles and can be so adjusted as to be used as a large shackle lock or a small shackle lock.

It is still another objective of the present invention to provide a shackle lock, which is composed of two shackles and can be carried around easily.

The foregoing objectives of the present invention are attained by a U-shaped shackle lock comprising a body, a first shackle, a second shackle, and two holding bodies. The first shackle is engageable at both ends thereof with two insertion holes of the body while the second shackle is engageable at both ends thereof with the two holding bodies, which are provided respectively with an axial hole in which the body is held. The two holding bodies are further provided respectively with two oblong through holes corresponding in location to the insertion hole of the body. The two oblong through holes of the holding body are opposite in location to each other. One of the two oblong through holes of each of the two holding bodies is engageable with the first shackle.

DETAILED DESCRIPTION OF THE INVENTION

Figure 1:
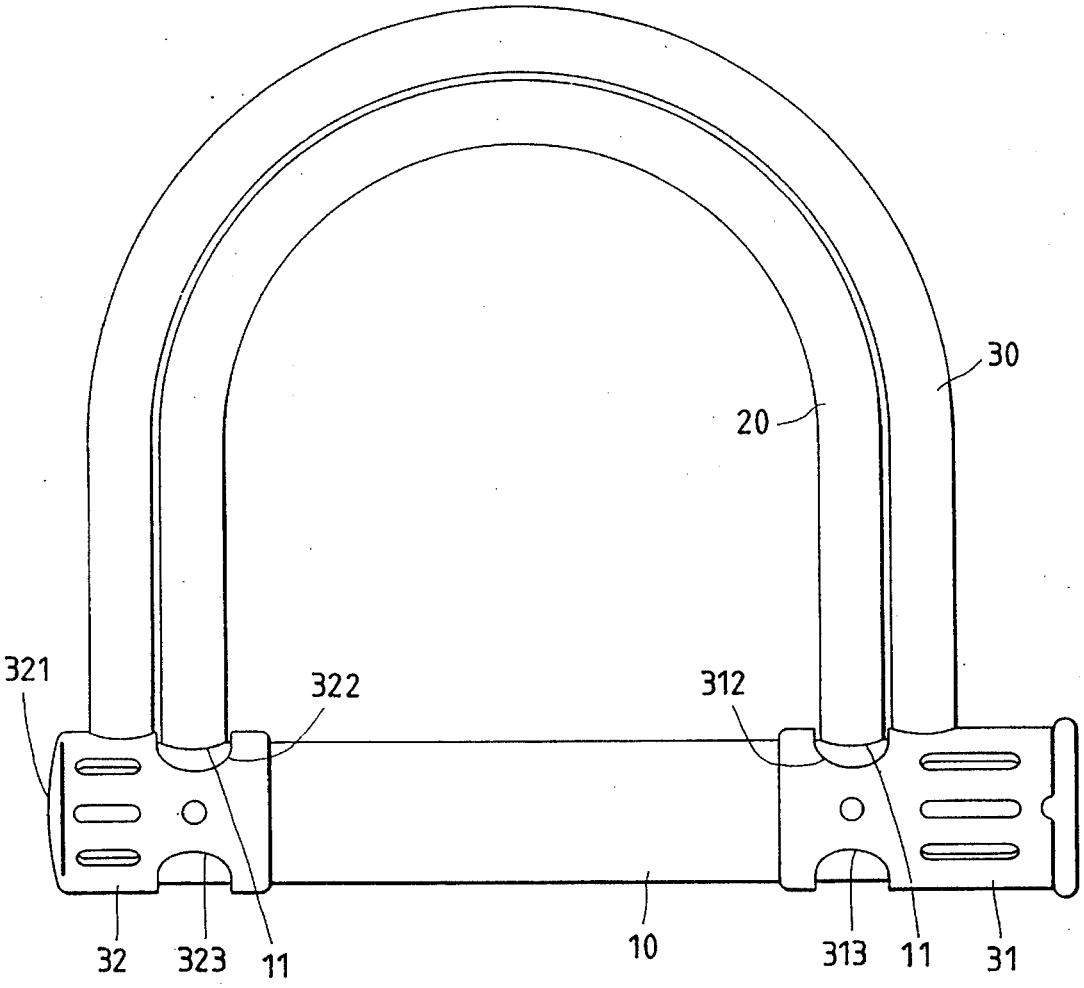
FIG. 1 shows a front elevational view of a first preferred embodiment of the present invention.
Figure 2:
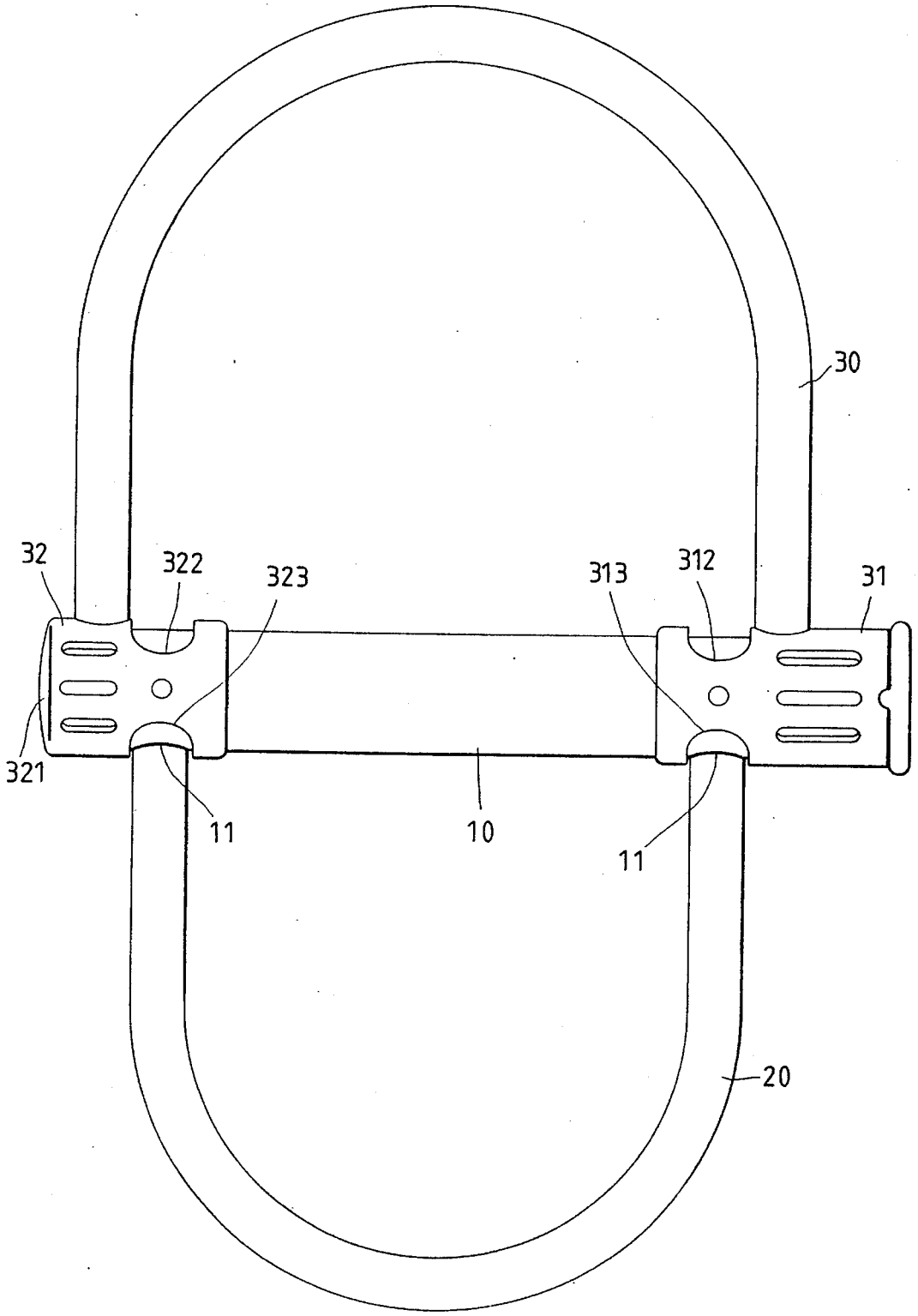
FIG. 2 shows another front elevational view of the first preferred embodiment of the present invention.
Figure 3:
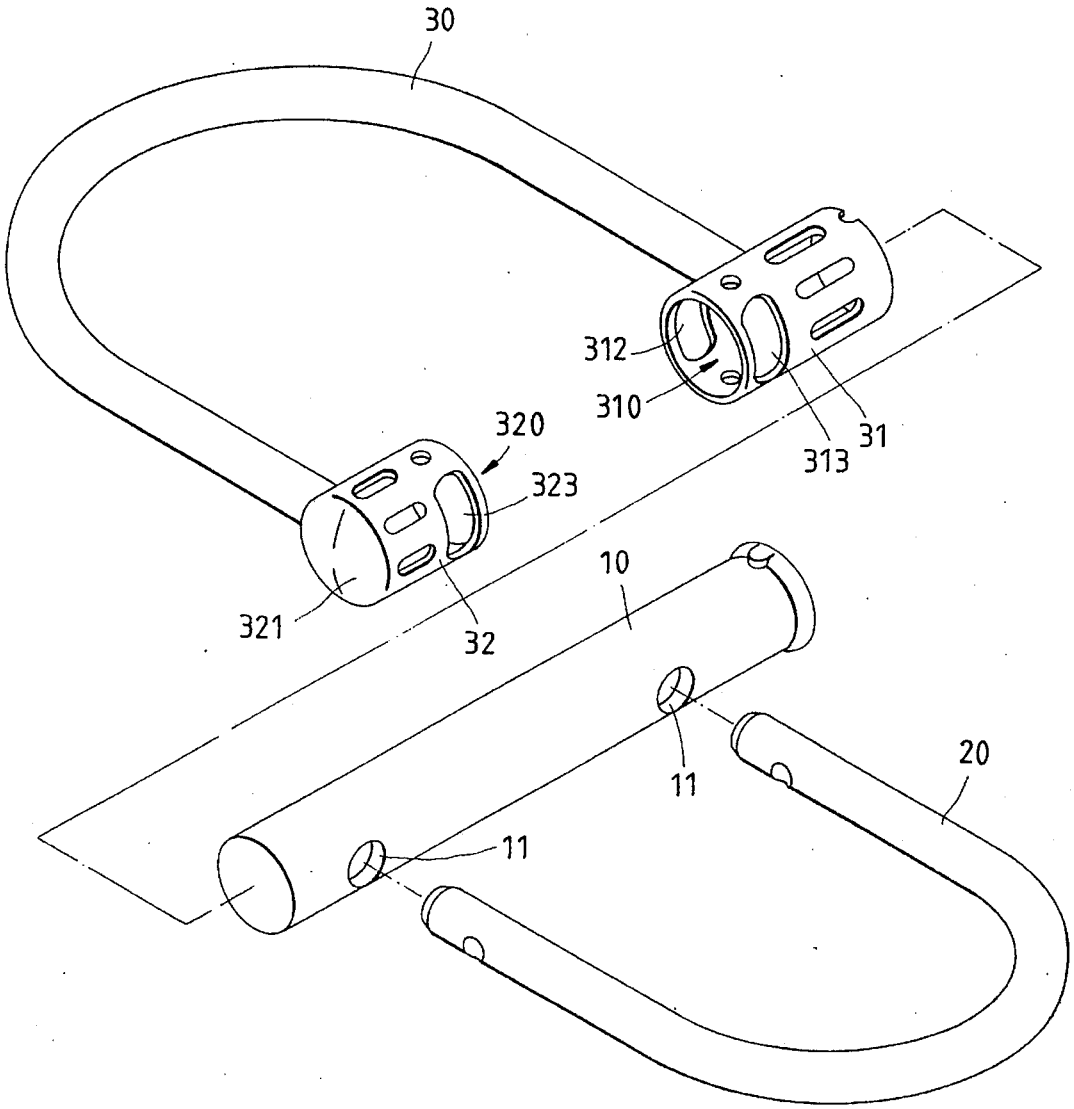
FIG. 3 shows an exploded view of the first preferred embodiment of the present invention.

As shown in FIGS. 1–3, a shackle lock of the first preferred embodiment of the present invention comprises the component parts which are described explicitly hereinafter.

A body 10 of a columnar construction is provided with two insertion holes 11 and a lock core (not shown in the drawings) engageable with a key capable of actuating a locking mechanism (not shown in the drawings) of the body 10.

A first shackle 20 of a U-shaped construction is engageable securely at both ends thereof with the two insertion holes 11 of the body 10.

A second shackle 30 of a U-shaped construction is greater than the first shackle 20.

Two holding bodies 31 and 32 are provided with axial holes 310 and 320, which have an inner diameter slightly greater than the outer diameter of the body 10. The two holding bodies 31 and 32 are fixed to both ends of the second shackle 30 such that the axes of the axial holes 310 and 320 of the two holding bodies 31 and 32 are located on the same center line. The holding body 32 is provided at the outer end thereof with an end wall 321 dimensioned to seal off the axial hole 320. The body 10 is received at both ends thereof in the axial holes 310 and 320 of the two holding bodies 31 and 32. The end wall 321 serves as a baffle. The holding body 31 is provided with two oblong through holes 312 and 313, which are opposite in location to each other. Similarly, the holding body 32 is provided with two oblong through holes 322 and 323, which are opposite in location to each other. The first shackle 20 can be held securely at both ends thereof in the insertion holes 11 of the body 10 such that both ends of the first shackle 20 pass through respectively the oblong through holes 312, 322, 313 and 323.

As shown in FIG. 1, the first shackle 20 is retained at both ends thereof in the insertion holes 11 of the body 10 such that both ends of the first shackle 20 pass through the oblong through holes 312 and 322 of the two holding bodies 31 and 32. Both the first and the second shackles 20 and 30 work together to fasten securely an object. The two holding bodies 31 and 32 are made of a thick steel tube and are so punched as to reduce the body weight. The two holding bodies 31 and 32 serve to reinforce the structural strength of the body 10, thereby protecting the body 10 from being tampered with.

The first shackle 20 can be easily engaged or disengaged with the body 10 in view of the fact that the first and the second shackles 20 and 30 are staggered at a predetermined angle, such as an angle of 45 degrees, and that the through holes 312, 322, 313 and 323 are oblong in construction.

As stated previously, the first shackle 20 can be disengaged with the body 10. As a result, the body 10 can be disengaged with the two holding bodies 31 and 32 so as to enable the second shackle 30 to be fastened with a bicycle or a telephone pole. Thereafter, the body 10 is engaged with the two holding bodies 31 and 32 such that the insertion holes 11 of the body 10 are aligned with the oblong through holes 313 and 323. The first shackle 20 is fastened with another bicycle before the first shackle 20 is engaged with the insertion holes 11 via the oblong through holes 313 and 323, as shown in FIG. 2. The shackle lock of the present invention is therefore capable of locking two bicycles at the same time or of fastening a bicycle to a telephone pole or tree. In addition, the first and the second shackles 20 and 30 provide dual protections when the shackle lock of the present invention is used to lock only one object, such as a door. Moreover, the shackle lock of the present invention can not be tampered with by means of a jack in view of the fact that the body 10 is held between the two shackles 20 and 30.

Figure 4:
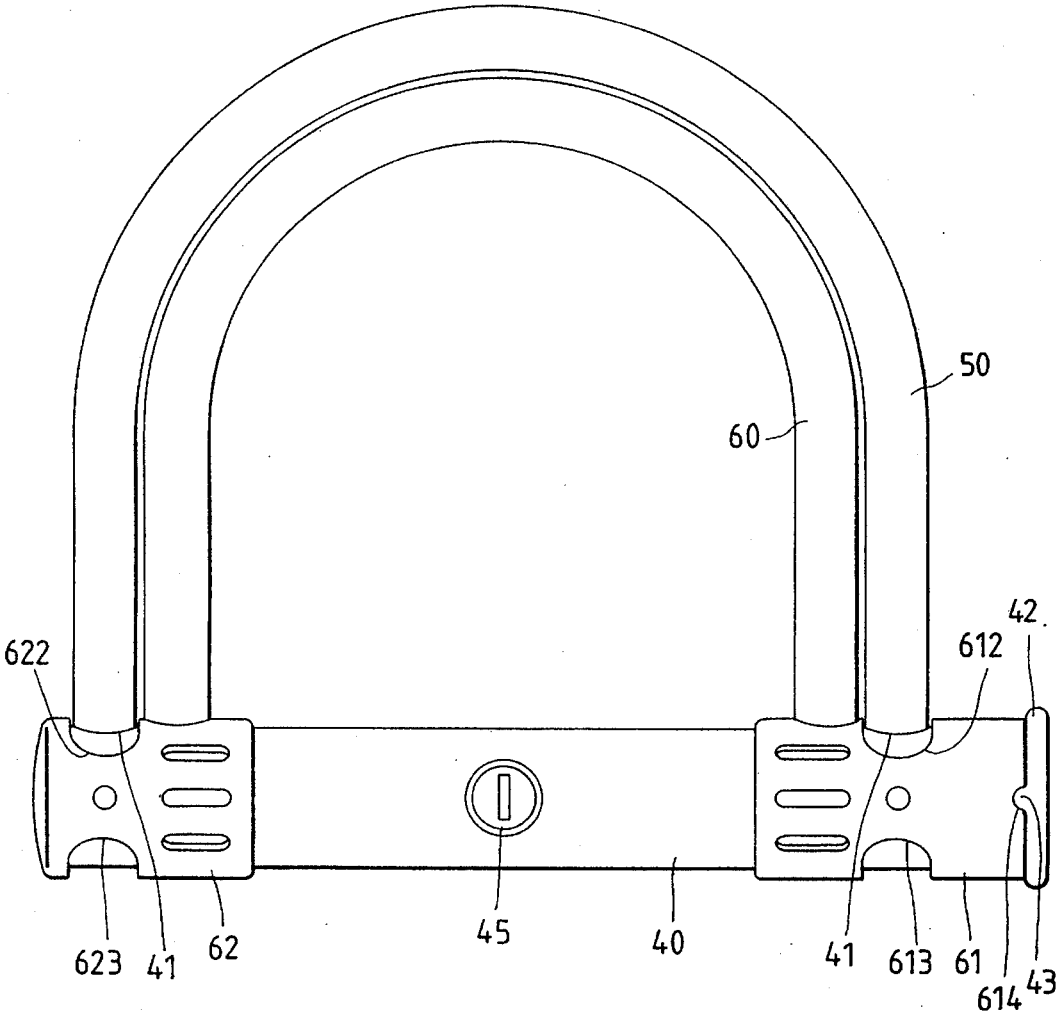
FIG. 4 shows a front elevational view of a second preferred embodiment of the present invention.

The shackle lock of the second preferred embodiment of the present invention is shown in FIG. 4 and is composed of a body 40, a first shackle 50, a second shackle 60, and two holding bodies 61 and 62. The second preferred embodiment is different from the first preferred embodiment in design in that the second shackle 60 is smaller than the first shackle 50, and that two holding bodies 61 and 62 are provided with the oblong through holes 612, 622, 613, and 623, which are corresponding in location to both ends of the first shackle 50. In other words, the first and the second shackles 50 and 60 of the second preferred embodiment are arranged in a way that is opposite to the way in which the first and the second shackles 20 and 30 of the first preferred embodiment are arranged. As shown in FIG. 4, the second preferred embodiment of the present invention is provided with a lock core 45 located at the center of the body 40.

The body 40 is further provided at one end thereof with a circular projection 42 dimensioned to fasten securely with the holding body 61, so as to facilitate the disengaging of the body 40 with the holding bodies 61 and 62. In addition, the circular projection 42 is provided on the inner side thereof with a protuberance 43 corresponding in location to and engageable securely with a retaining slot 614 of the holding body 61. As a result, the insertion holes 41 of the body 40 are aligned with the oblong through holes 612 and 622, or with the oblong through holes 613 and 623 when the body 40 are engaged with the two holding bodies 61 and 62. The first shackle 50 can be therefore engaged easily with the insertion holes 41 of the body 40.

What is claimed is:

1. A shackle lock comprising:

a body having a lock and further provided with two insertion holes;

a first shackle of a U-shaped construction and engageable securely at both ends thereof with said two insertion holes of said body;

a second shackle of a U-shaped construction and different in dimension than said first shackle; and two holding bodies fastened respectively with both ends of said second shackle and provided respectively with an axial hole dimensioned to receive therein one end of said body, said two holding bodies further provided respectively with two through holes which are opposite in location to each other and are corresponding in location to one of said two insertion holes of said body, said through holes of said two holding bodies and said insertion holes of said body being engageable in locking arrangement with both ends of said first shackle.

2. The shackle lock as defined in claim 1, wherein one of said two holding bodies is provided at an outer end of said axial hole thereof with an end wall for locating said body.

3. The shackle lock as defined in claim 1, wherein said body is of a columnar construction; and wherein said two holding bodies are of a cylindrical construction and have an inner diameter larger than an outer diameter of said body.

4. The shackle lock as defined in claim 1, wherein said second shackle is greater in dimension than said first shackle.

5. The shackle lock as defined in claim 1, wherein said second shackle is smaller in dimension than said first shackle.

6. The shackle lock as defined in claim 1, wherein said body is provided at one end thereof with a projection circular in shape and having an outer portion greater in size than an inner portion of said holding body.

7. The shackle lock as defined in claim 1, wherein said body is provided at one end thereof with a protuberance corresponding in location to and engageable securely with a retaining slot of said holding body.

* * * * *